US009931868B2

(12) United States Patent
Yamashita

(10) Patent No.: US 9,931,868 B2
(45) Date of Patent: Apr. 3, 2018

(54) RECORDING APPARATUS WITH TRANSPORT BELT PRESSING ROLLER AND SUPPORT UNIT

(71) Applicant: SEIKO EPSON CORPORATION, Tokyo (JP)

(72) Inventor: Takahiro Yamashita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/434,350

(22) Filed: Feb. 16, 2017

(65) Prior Publication Data

US 2017/0239958 A1 Aug. 24, 2017

(30) Foreign Application Priority Data

Feb. 19, 2016 (JP) ..... 2016-029615

(51) Int. Cl.
*B41J 11/00* (2006.01)
*B65H 20/06* (2006.01)
*B65H 5/02* (2006.01)

(52) U.S. Cl.
CPC ..... *B41J 11/007* (2013.01); *B65H 5/025* (2013.01); *B65H 20/06* (2013.01); *B65H 2404/531* (2013.01)

(58) Field of Classification Search
CPC ..... B41J 11/007; B65H 20/06; B65H 5/025; B65H 2404/531
See application file for complete search history.

(56) References Cited

U.S. PATENT DOCUMENTS 6,672,705 B2 * 1/2004 Kitahara ..... B41J 2/155 347/19
6,695,504 B2 * 2/2004 Matsumoto ..... B41J 11/007 271/193
7,682,016 B2 * 3/2010 Sakuma ..... B41J 11/007 271/272
2011/0050825 A1 3/2011 Murata et al.
2014/0063109 A1 3/2014 Nakamura

FOREIGN PATENT DOCUMENTS

JP 2002-145474 A 5/2002
JP 2008-201564 A 9/2008
JP 2011-051165 A 3/2011
JP 2014-047442 A 3/2014

OTHER PUBLICATIONS

The Extended European Search Report for the corresponding European Patent Application No. 17155479.3 dated Jul. 13, 2017.

* cited by examiner

*Primary Examiner* — Henok Legesse

(57) ABSTRACT

A recording apparatus which includes a transport belt which transports a medium; a pressing roller which presses the medium to the transport belt; and a support unit which can support the transport belt, in which at least a part of a portion of the support unit, which faces the pressing roller through the transport belt is subjected to friction relief processing. By setting to a recording apparatus with such a configuration, it is possible to suppress an increase in friction force between the transport belt and the support unit which can support the transport belt.

9 Claims, 4 Drawing Sheets

RECORDING APPARATUS WITH TRANSPORT BELT PRESSING ROLLER AND SUPPORT UNIT

BACKGROUND

1. Technical Field

The present invention relates to a recording apparatus.

2. Related Art

In the related art, various recording apparatuses have been used. Among these, a recording apparatus that is provided with a transport belt which transports a medium and that performs recording on a medium transported by the transport belt is disclosed.

For example, in JP-A-2014-47442, and JP-A-2011-51165, a recording apparatus which performs recording by ejecting ink onto a medium which is transported by a transport belt is disclosed.

There are various configurations of a recording apparatus provided with a transport belt which transports a medium, and for example, as disclosed in JP-A-2014-47442, there is an apparatus provided with a pressing roller (press roller) which presses a medium onto a transport belt, or an apparatus provided with a support unit (suctioning platen) which can support a transport belt as disclosed in JP-A-2011-51165.

However, with a configuration in which the pressing roller which presses a medium onto a transport belt, and a support unit which can support the transport belt are provided, there has been a case in which friction increases between the transport belt and the support unit at a position where the medium faces the pressing roller, or the like, due to interference caused by a foreign substance, or the like.

SUMMARY

An advantage of some aspects of the invention is to suppress an increase in friction between a transport belt and a support unit which supports the transport belt.

According to an aspect of the invention, there is provided a recording apparatus which includes a transport belt which transports a medium; a pressing roller which presses the medium to the transport belt; and a support unit which can support the transport belt, in which friction is relieved on at least a part of a portion of the support unit that faces the pressing roller with the transport belt disposed therebetween.

According to the aspect, the transport belt, the pressing roller, and the support unit are provided, and at least a part of a portion of the support unit which faces the pressing roller through the transport belt is subjected to friction relief processing. For this reason, it is possible to suppress an increase in friction between the transport belt and the support unit.

In the recording apparatus, in the aspect, friction relief may be provided by reducing the contact area of the support unit with respect to the transport belt.

According to the aspect, the support unit is subjected to the contact area reducing processing with respect to the transport belt, as the friction relief processing. For this reason, it is possible to suppress an increase in friction between the transport belt and the support unit by reducing the contact area between the transport belt and the support unit.

In the recording apparatus, in the aspect, the support unit may be provided with a protruding portion for reducing the contact area, and an apex portion of the protruding portion may be in contact with the transport belt.

According to the aspect, the support unit is provided with the protruding portion for reducing the contact area, and the apex portion of the protruding portion is in contact with the transport belt. For this reason, it is possible to suppress an increase in friction force between the transport belt and the support unit by reducing the contact area between the support unit and the transport belt by causing the transport belt and the apex portion of the protruding portion to be in contact with each other.

In the recording apparatus, in the aspect, the support unit may be provided with a protruding portion including a ridge as the contact area reducing processing, and the ridge may be in contact with the transport belt.

According to the aspect, the support unit is provided with the protruding portion including a ridge as the contact area reducing processing, and the ridge is in contact with the transport belt. For this reason, it is possible to suppress an increase in friction force between the transport belt and the support unit by reducing the contact area between the support unit and the transport belt, by causing the transport belt and the ridge of the protruding portion to be in contact with each other.

In the recording apparatus, in the aspect, the ridge may be formed in a transport direction of the medium.

According to the aspect, the ridge is formed along the transport direction of the medium. For this reason, it is particularly possible to effectively suppress an increase in friction force between the transport belt and the support unit.

In the recording apparatus, in the aspect, a sliding property improving material with which sliding properties with respect to the transport belt can be improved may be disposed in the support unit, as the friction relief processing.

According to the aspect, the sliding property improving material with which sliding properties with respect to the transport belt can be improved is disposed in the support unit to achieve friction relief. For this reason, it is possible to suppress an increase in friction force between the transport belt and the support unit by improving sliding properties between the support unit and the transport belt.

In the recording apparatus, in the aspect, the support unit in the recording apparatus may be coated with the sliding property improving material to achieve friction relief.

According to the aspect, the support unit is coated with the sliding property improving material to achieve friction relief. For this reason, it is possible to suppress an increase in friction force between the transport belt and the support unit by improving sliding properties between the support unit and the transport belt by causing a portion of the support unit which is coated with the sliding property improving material to be in contact with the transport belt.

In the recording apparatus, in the aspect, the support unit in the recoding apparatus may be provided with the sliding property improving material to achieve friction relief.

According to the aspect, the support unit is provided with the sliding property improving material to achieve friction relief. For this reason, it is possible to suppress an increase in friction force between the transport belt and the support unit by improving sliding properties between the support unit and the transport belt by causing the sliding property improving material, which forms the support unit, to be in contact with the transport belt.

In the recording apparatus, in the aspect, the transport belt in the recording apparatus may be an adhesive belt of which a support face of the medium is painted with an adhesive, and the support unit may be subjected to the friction relief processing on a face which faces an end portion in a width direction of the transport belt.

In a case in which the transport belt is an adhesive belt, there is a case in which an adhesive comes around or migrates, as a foreign substance, into an end portion in the width direction of a face which is a face on a side opposite to a support face and faces the support unit from the end portion in the width direction of the support face which is painted with the adhesive, and a friction force between the transport belt and the support unit increases. According to the aspect, the transport belt is the adhesive belt of which the support face of the medium is painted with an adhesive, and the support unit is subjected to the friction relief processing on a face which faces the end portion in the width direction of the transport belt. For this reason, it is possible to suppress an increase in friction force between the transport belt and the support unit, even when the transport belt is an adhesive belt. Since it is possible for the support unit to suppress the increase in friction force between the transport belt and the support unit, even when the friction relief processing is not performed on a face which faces a center portion in the width direction of the transport belt, when the face which faces the end portion in the width direction of the transport belt is subjected to the friction relief processing, it is possible to reduce the cost of friction relief processing by performing the friction relief processing only in the end portion in the width direction of the transport belt.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to one embodiment of the invention will be described with reference to the accompanying drawings.

First Embodiment (FIGS. 1 to 4B)

First, an outline of a recording apparatus 1 according to a first embodiment of the invention will be described.

Figure 1:
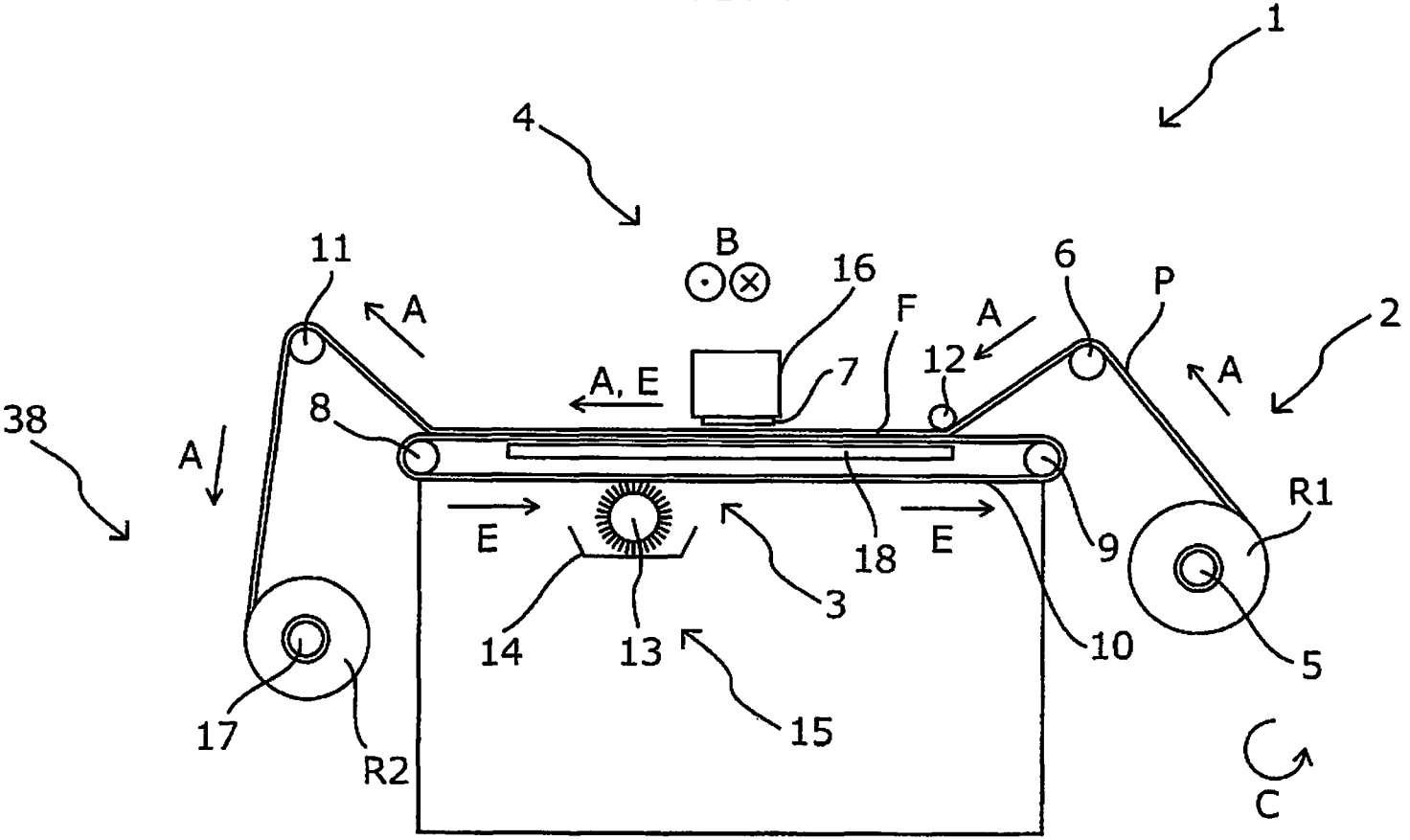
FIG. 1 is a schematic side view which illustrates a recording apparatus according to a first embodiment of the invention.

FIG. 1 is a schematic side view of the recording apparatus 1 according to the embodiment.

The recording apparatus 1 according to the embodiment is provided with a feeding unit 2 which can reel out a roll R1 of a medium for recording (medium) P for performing recording. A transport mechanism 3 which transports the medium for recording P in a transport direction A using an adhesive belt 10 (transport belt formed of an endless belt) which supports the medium for recording P on a support face F onto which an adhesive is disposed is further provided. A recording mechanism 4 which performs recording on the medium for recording P by causing a carriage 16 including a recording head 7 which ejects ink to perform reciprocating scanning in a reciprocating direction B, which intersects the transport direction A of the medium for recording P, is further provided. A cleaning mechanism 15 of the adhesive belt 10 is further provided. A winding mechanism 38 including a winding shaft 17 which winds up the medium for recording P is further provided.

The feeding unit 2 is provided with a rotating shaft 5 which is also a position for setting the roll R1 of the medium for recording P for performing recording and has a configuration with which it is possible to reel out, from the roll R1 which is disposed on the rotating shaft 5, the medium for recording P toward the transport mechanism 3 by using a driven roller 6. In addition, when reeling out the medium for recording P toward the transport mechanism 3, the rotating shaft 5 rotates in a rotation direction C.

The transport mechanism 3 is provided with the adhesive belt 10 which transports the medium for recording P reeled out from the feeding unit 2 by mounting thereon, and a driving roller 8 and a driven roller 9 which move the adhesive belt 10 in a direction E. The medium for recording P is attached to the support face F of the adhesive belt 10 by being pressed by the pressing roller 12 and is mounted. The driving roller 8 rotates in a rotation direction C when the medium for recording P is transported.

However, the endless belt as the transport belt is not limited to the adhesive belt. For example, an endless belt of an electrostatic adsorption type may be used.

A platen 18 as a support unit which can support the adhesive belt 10 is provided under the adhesive belt 10 according to the embodiment. Since the platen 18 supports the adhesive belt 10, it is possible to suppress vibration of the adhesive belt 10 which is associated with movement thereof.

In addition, the pressing roller 12 in the embodiment is configured so as to reciprocate (swing) in the transport direction A in order to suppress formation of a contact mark on the medium for recording P by being in contact with the same portion of the medium for recording P for a certain time. However, the pressing roller 12 is not limited to such a configuration.

In FIG. 1, and FIGS. 3A to 4B which will be described later, a contact portion between the pressing roller 12 and the medium for recording P, or the like, is illustrated in a simplified manner, and a contact angle between the pressing roller 12 and the medium for recording P (approach angle of the medium for recording P) is the same in FIG. 1 and in FIGS. 3A to 4B.

The recording mechanism 4 includes a carriage motor 30 (refer to FIG. 2) which causes the carriage 16 including the recording head 7 to reciprocate in the reciprocating direction B. In FIG. 1, the reciprocating direction B is a direction perpendicular to a paper surface.

Recording is performed by causing the carriage 16 including the recording head 7 to reciprocate during recording; however, the transport mechanism 3 stops transporting of the medium for recording P in the middle of recording scanning (during movement of carriage 16). In other words, reciprocating scanning of the carriage 16 and transporting of the medium for recording P are alternately performed when performing recording. That is, when performing recording, the transport mechanism 3 intermittently transports the medium for recording P (intermittent movement of adhesive belt 10) in response to reciprocating scanning of the carriage 16.

In addition, the recording apparatus 1 according to the embodiment is provided with the recording head 7 which ejects ink while reciprocating in the reciprocating direction B; however, the recording apparatus 1 may be a printing apparatus provided with a so-called line head in which a plurality of nozzles which eject ink are provided in a direction intersecting the movement direction of the medium for recording P.

Here, the "line head" is a recording head in which a region of nozzles, which are formed in the direction intersecting the movement direction of the medium for recording P, is provided so as to cover the entire intersecting direction and is used in a recording apparatus which forms an image by causing the recording head or the medium for recording P to move relative to each other. In addition, the region of the nozzles in the intersecting direction of the line head may not cover the entire intersecting direction of the medium for recording P to which the recording apparatus responds.

The cleaning mechanism 15 of the adhesive belt 10 includes a cleaning brush 13 formed of a plurality of cleaning rollers which are connected in a rotating shaft direction, and a tray 14 in which detergent for cleaning the cleaning brush 13 is accommodated.

The winding mechanism 38 is a mechanism for winding up the medium for recording P on which recording is performed, which is transported from the transport mechanism 3 by using a driven roller 11, and can wind up the medium for recording as a roll R2 of the medium for recording P, by disposing a paper tube, or the like, for winding on the winding shaft 17, and winding the medium for recording P around the paper tube.

Subsequently, an electrical configuration in the recording apparatus 1 according to the embodiment will be described.

Figure 2:
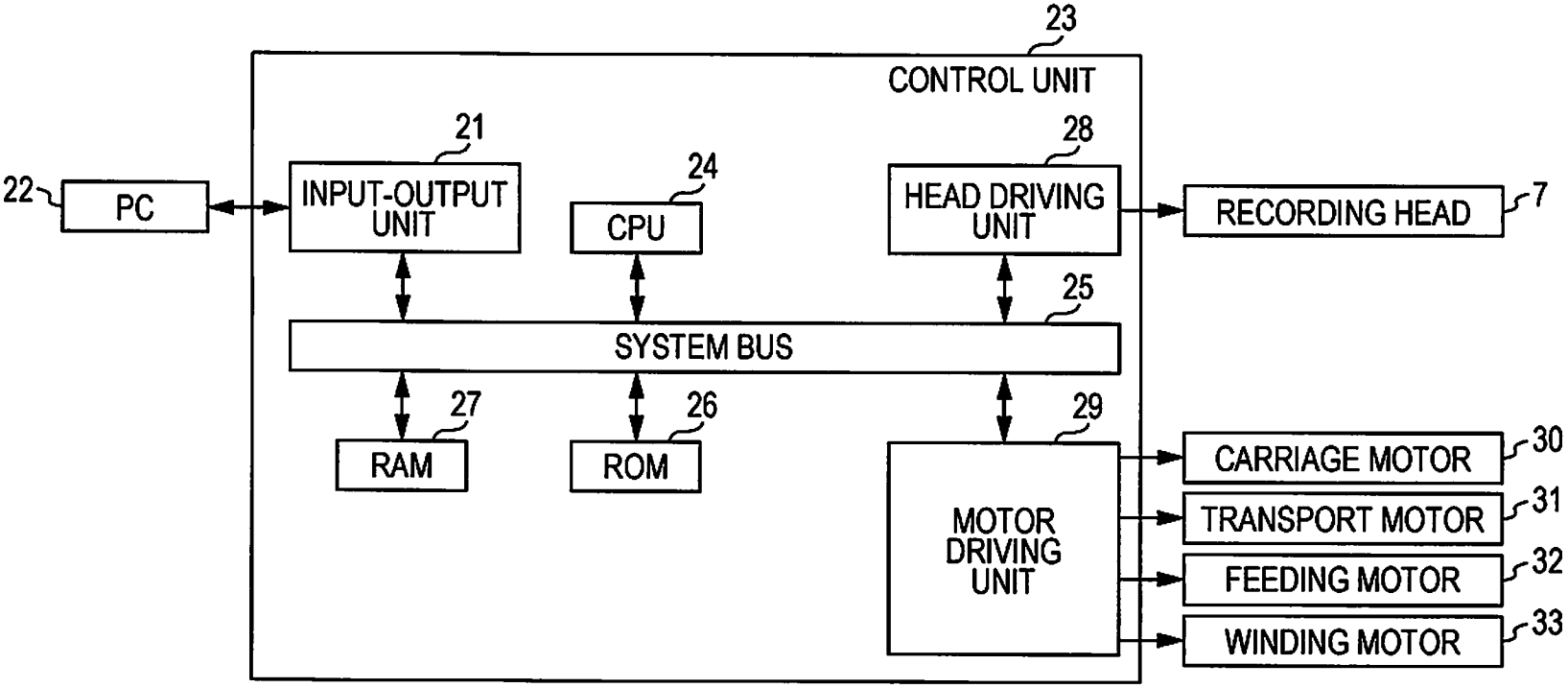
FIG. 2 is a block diagram which illustrates the recording apparatus according to the first embodiment of the invention.

FIG. 2 is a block diagram of the recording apparatus 1 according to the embodiment.

A CPU 24 which manages control of the entire recording apparatus 1 is provided in a control unit 23. The CPU 24 is connected, via a system bus 25, to a ROM 26, which stores various control programs and the like, which are executed by the CPU 24, and a RAM 27, which can temporarily store data.

In addition, the CPU 24 is connected, via the system bus 25, to a head driving unit 28 for driving the recording head 7.

The CPU 24 is further connected, via the system bus 25, to a motor driving unit 29 for driving the carriage motor 30, a transport motor 31, a feeding motor 32, and a winding motor 33.

Here, the carriage motor 30 is a motor for moving the carriage 16 that includes the recording head 7. The transport motor 31 is a motor for driving the driving roller 8. The feeding motor 32 provides the mechanism for rotating the rotating shaft 5 and is a motor for driving the rotating shaft 5 in order to send the medium for recording P to the transport mechanism 3. In addition, the winding motor 33 is a driving motor for rotating the winding shaft 17.

The CPU 24 is further connected, via the system bus 25, to an input-output unit 21, and the input-output unit 21 is connected, via the system bus 25, to a PC 22 for performing transceiving of data such as recording data and signals.

The control unit 23 can control the entire recording apparatus 1 with such a configuration.

Subsequently, the platen 18 as a main portion of the recording apparatus 1 in the embodiment will be described.

Figure 3A:
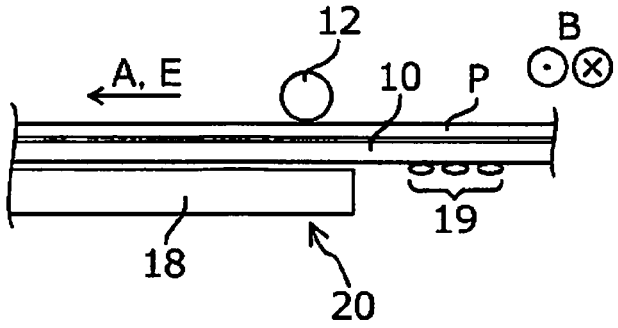
FIG. 3A is a schematic side view which illustrates main portions of the recording apparatus according to the first embodiment of the invention.
Figure 3B:
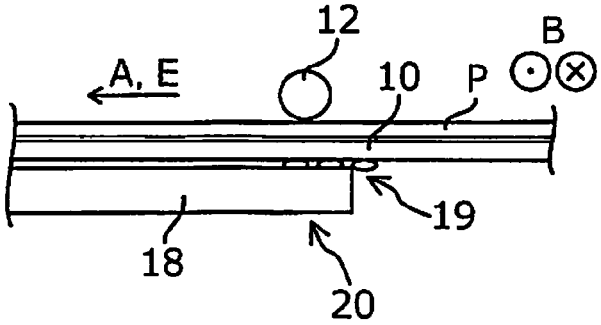
FIG. 3B is a schematic side view which illustrates main portions of the recording apparatus according to the first embodiment of the invention.

Here, FIGS. 3A and 3B are schematic side views which illustrate the periphery of the portion 20 of the platen 18 of the recording apparatus 1 according to the embodiment which faces the pressing roller 12. FIG. 3A illustrates a state in which a foreign substance 19 (for example, adhesive painted on the support face F of the adhesive belt that has migrated around to the opposite side of the adhesive belt) approaches the portion 20 facing the pressing roller 12, and FIG. 3B illustrates a state in which the foreign substance 19 reaches the portion 20 facing the pressing roller 12.

Figure 4A:
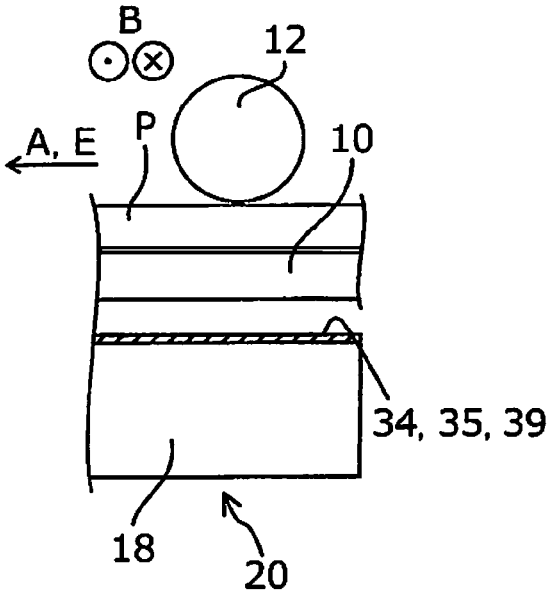
FIG. 4A is a schematic side view which illustrates main portions of the recording apparatus according to the first embodiment of the invention.
Figure 4B:
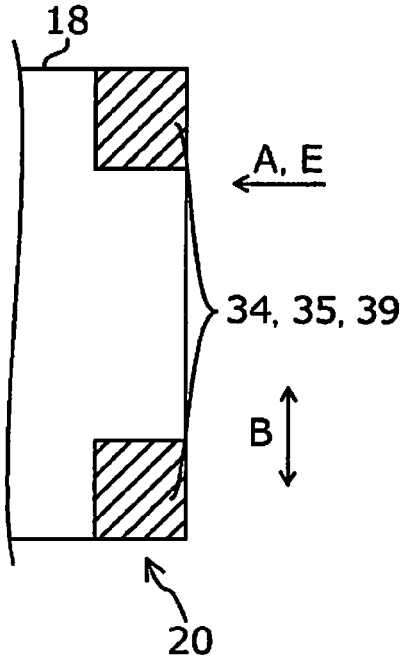
FIG. 4B is a schematic plan view which illustrates main portions of the recording apparatus according to the first embodiment of the invention.

FIGS. 4A and 4B are schematic views which illustrate the periphery of the portion 20 of the platen 18 of the recording apparatus 1 according to the embodiment which faces the pressing roller 12. FIG. 4A is a side view and FIG. 4B is a plan view, and in FIG. 4B, constituent members other than the platen 18 are omitted in order to make the shape of the platen 18 easy to grasp.

In the recording apparatus provided with the transport belt which transports a medium, as illustrated in FIGS. 3A and 3B, there is a case in which a foreign substance is attached to a side opposite to the support face of the medium (medium for recording P) of the transport belt (adhesive belt 10). In particular, in a configuration of including the adhesive belt 10 as the transport belt, there is a case in which an adhesive painted on the adhesive belt 10 becomes a foreign substance by coming around onto into the side opposite to the support face of the medium. In addition, when a state illustrated in FIG. 3A proceeds to a state illustrated in FIG. 3B in association with movement of the adhesive belt 10 in the direction E, there is a case in which a foreign substance 19 such as an adhesive, or the like, comes into contact with the portion 20 in the platen 18 which faces the pressing roller 12. The reason for this is that the adhesive belt 10 is an endless belt, and accordingly, is flexible, and when the pressing roller 12 presses the medium for recording P onto the adhesive belt 10, the adhesive belt 10 is pressed by the platen 18 due to the force. Then, a friction force between the adhesive belt 10 and the portion 20 in the platen 18, which faces the pressing roller 12, increases due to an influence (interference) of the foreign substance 19 such as the adhesive, and there are concerns of causing an abnormal sound, increasing the movement load of the adhesive belt 10, degrading the movement accuracy of the adhesive belt 10, or the like.

For this reason, in the recording apparatus 1 according to the embodiment, as illustrated in FIG. 4 (FIGS. 4A and 4B), friction relief processing 34 is performed on the face 39 which faces an end portion (end portion in width direction of adhesive belt 10) of the portion 20 in the reciprocating direction B which faces the pressing roller 12 in the platen 18.

That is, the recording apparatus 1 according to the embodiment is provided with the adhesive belt 10 which transports the medium for recording P, the pressing roller 12 which presses the medium for recording P to the adhesive belt 10, and the platen 18 which can support the adhesive belt 10, and the platen 18 is subjected to the friction relief processing 34 in at least a portion of the portion 20 which faces the pressing roller 12 through the adhesive belt 10.

For this reason, it is a configuration in which an increase in friction force between the adhesive belt 10 and the platen 18 can be suppressed.

As illustrated in FIG. 1, the adhesive belt 10 according to the embodiment is an adhesive belt of which the support face F of the medium for recording P is painted with an adhesive. In addition, the platen 18 is subjected to the friction relief processing 34 on the face 39 which faces the end portion in the width direction of the adhesive belt 10 as illustrated in FIG. 43.

In a case in which the transport belt is the adhesive belt 10, as in the recording apparatus 1 according to the embodiment, there is a case in which an adhesive migrates to an end portion in the width direction of a face which faces the platen 18 which is a face on a side opposite to the support face F, as foreign substances, from the end portion in the width direction of the support face F on which the adhesive is painted, and a friction force between the adhesive belt 10 and the platen 18 increases. Here, the transport belt of the recording apparatus 1 according to the embodiment is the adhesive belt 10 in which an adhesive is painted on the support face F of the medium for recording P. In addition, as described above, the face 39 which faces the end portion in the width direction of the adhesive belt 10 is subjected to the friction relief processing 34, in the platen 18. For this reason, in the recording apparatus 1 according to the embodiment, the transport belt is the adhesive belt 10; however, it is set to a configuration in which the friction force between the adhesive belt 10 and the platen 18 can be suppressed.

When the friction relief processing 34 is performed on the face 39 which faces the end portion in the width direction of the adhesive belt 10, the platen 18 can suppress an increase in friction force between the adhesive belt 10 and the platen 18, even when the friction relief processing 34 is not performed on a face which faces a center portion in the width direction of the adhesive belt 10. For this reason, in the recording apparatus 1 according to the embodiment, an increase in friction force between the adhesive belt 10 and the platen 18 is suppressed while reducing a cost for the friction relief processing 34, by performing the friction relief processing 34 only on the face 39 which faces the end portion in the width direction of the adhesive belt 10, in the platen 18.

The face 39 which faces the end portion in the width direction of the adhesive belt 10 may be a face which can face the end portion in the width direction of the adhesive belt 10, and may include a region which faces a portion other than the end portion in the width direction of the adhesive belt 10, or a part of a portion which does not face the adhesive belt 10.

The friction relief processing may be performed also in the adhesive belt 10 (in particular, face which is end portion in width direction, and faces the face 39 of platen 18), not only in the platen 18.

In the platen 18 of the recording apparatus 1 according to the embodiment, a sliding property improving material 35 which can improve sliding properties with respect to the adhesive belt 10 is disposed as the friction relief processing 34. In this manner, it is possible to suppress an increase in friction force between the adhesive belt 10 and the platen 18, by improving sliding properties between the platen 18 and the adhesive belt 10.

As a specific example of the "placement", for example, it is possible to perform the placement using various methods such as "applying", "attaching", "coating", "deposition", or the like.

Specifically, in the platen 18 according to the embodiment, a fluororesin (polytetrafluoroethylene) is coated as the sliding property improving material 35, as the friction relief processing 34. In addition, an increase in friction force between the adhesive belt 10 and the platen 18 is suppressed by improving sliding properties of the platen 18 and the adhesive belt 10, by causing the adhesive belt 10 to be in contact with the portion which is coated with the sliding property improving material 35 (fluororesin) of the platen 18 (that is, portion 20 which faces pressing roller 12).

Placement of the sliding property improving material 35 in the embodiment is fluororesin coating; however, it is not limited to such a configuration. For example, ceramic may be coated, instead of fluororesin coating. In addition, a coating method is not particularly limited, as well, and the sliding property improving material 35 may be attached in the form of a sticker.

In addition, as the placement of the sliding property improving material 35 (friction relief processing 34), the platen 18 itself may be configured of the sliding property improving material 35. Also in such a configuration, it is possible to suppress an increase in friction force between the adhesive belt 10 and the platen 18 by improving sliding properties between the platen 18 and the adhesive belt 10, by causing the adhesive belt 10 to be in contact with the sliding property improving material 35 which configures the platen 18.

The sliding property improving material 35 is not particularly limited, and it is possible to preferably use polyacetal, polyimid, nylon (particularly, nylon 11, 12, 4-6, or the like), or the like, instead of the fluororesin or ceramic.

Figure 5A:
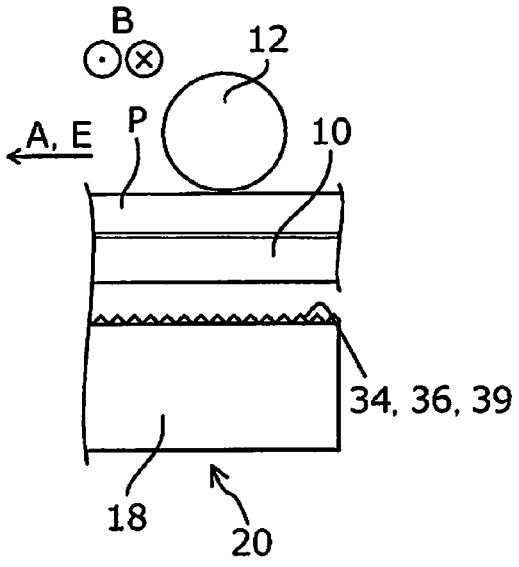
FIG. 5A is a schematic side view which illustrates main portions of a recording apparatus according to a second embodiment of the invention.
Figure 5B:
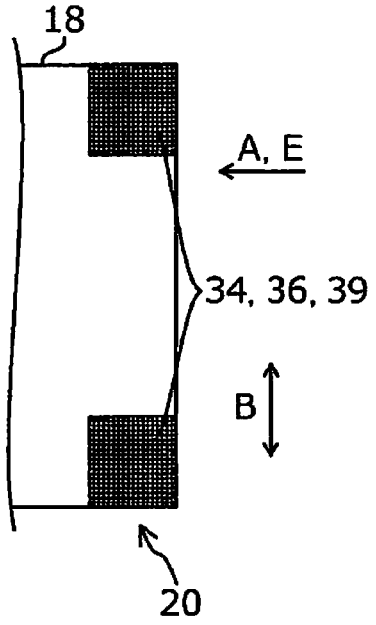
FIG. 5B is a schematic plan view which illustrates main portions of the recording apparatus according to the second embodiment of the invention.

Second Embodiment (FIGS. 5A and 5B)

Subsequently, a recording apparatus 1 according to a second embodiment will be described in detail with reference to accompanying drawings.

FIGS. 5A and 5B are schematic views which illustrate the periphery of the portion 20 which faces the pressing roller 12 in the platen 18 as a main portion of the recording apparatus 1 according to the second embodiment, and are diagrams corresponding to FIGS. 4A and 4B in the recording apparatus 1 according to the first embodiment.

The recording apparatus 1 according to the embodiment has the same configuration as that of the recording apparatus 1 in the first embodiment, except for the friction relief processing 34 of the platen 18.

In the recording apparatus 1 according to the first embodiment, the sliding property improving material 35 is disposed as the friction relief processing 34.

Meanwhile, the recording apparatus 1 according to the embodiment is subjected to contact area reducing processing in which a contact area with respect to the adhesive belt 10 is reduced, as the friction relief processing 34. In this manner, it is possible to suppress an increase in friction force between the adhesive belt 10 and the platen 18, by reducing the contact area between the platen 18 and the adhesive belt 10.

Specifically, as illustrated in FIGS. 5A and 5B, a protruding portion 36 is provided in the platen 18 according to the embodiment as the contact area reducing processing, and it is configured so that an apex portion of the protruding portion 36 is in contact with the adhesive belt 10. By causing the adhesive belt 10 and the apex portion of the protruding portion 36 to be in contact, a contact area between the platen 18 and the adhesive belt 10 is reduced, and an increase in friction force between the adhesive belt 10 and the platen 18 is suppressed.

The protruding portion 36 in the embodiment is formed in a conical shape; however, it is not limited to such a configuration, and may be a polygonal pyramid shape such as a trigonal pyramid shape or a square pyramid shape, or may be a configuration in which a tip end of the apex portion is an R shape (smooth). In addition, a contact portion between the adhesive belt 10 and the apex portion of the protruding portion 36 is not limited to a point contact, and the adhesive belt and the apex portion of the protruding portion may contact in a predetermined area.

Figure 6A:
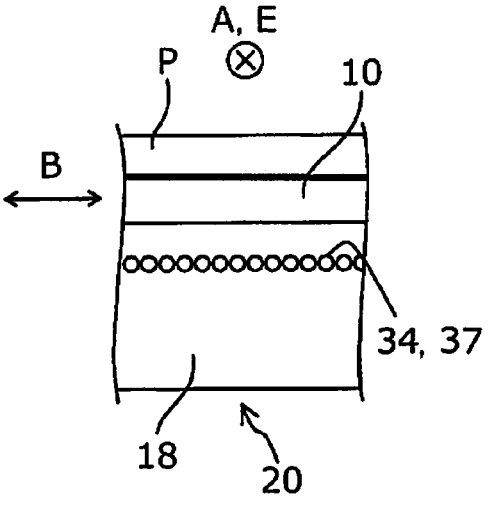
FIG. 6A is a schematic rear view which illustrates main portions of a recording apparatus according to a third embodiment of the invention.
Figure 6B:
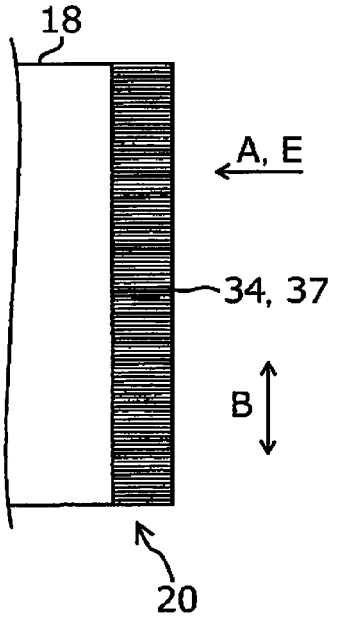
FIG. 6B is a schematic plan view which illustrates main portions of the recording apparatus according to the third embodiment of the invention.

Third Embodiment (FIGS. 6A and 6B)

Subsequently, a recording apparatus 1 according to a third embodiment will be described in detail with reference to accompanying drawings.

FIGS. 6A and 6B are schematic views which illustrate the periphery of the portion 20 which faces the pressing roller 12 in the platen 18 as a main portion of the recording apparatus 1 in the third embodiment. In these, FIG. 6A is a rear view, and FIG. 6B is a plan view corresponding to FIG. 4B of the recording apparatus 1 in the first embodiment, and FIG. 5B of the recording apparatus 1 in the second embodiment.

The recording apparatus 1 according to the embodiment has the same configuration as that of the recording apparatus 1 in the first or second embodiments, except for the friction relief processing 34 of the platen 18.

The platen 18 of the recording apparatus 1 according to the second embodiment has a configuration of including the plurality of protruding portions 36 as the contact area reducing processing.

Meanwhile, as illustrated in FIGS. 6A and 6B, the platen 18 of the recording apparatus 1 according to the embodiment has a configuration in which a plurality of columnar constituent members extend along the transport direction A, as the contact area reducing processing.

In other words, the platen 18 according to the embodiment has a configuration in which a protruding portion 37 with ridge is provided, as the contact area reducing processing, and the ridge is in contact with the adhesive belt 10. In addition, a contact area between the platen 18 and the adhesive belt 10 is reduced by causing the adhesive belt 10 and the ridge of the protruding portion 37 to be in contact, and an increase in friction force between the adhesive belt 10 and the platen 18 is suppressed.

In other words, the ridge of the platen 18 according to the embodiment is formed along the transport direction A of the medium for recording P. For this reason, it is a configuration in which the increase in friction force between the adhesive belt 10 and the platen 18 can be effectively suppressed, in particular.

The protruding portion 37 in the embodiment is formed in a columnar shape, and the ridge is formed in an arc shape. However, it is not limited to such a configuration. The contact portion between the adhesive belt 10 and the ridge of the protruding portion 37 is not limited to a line contact, and the adhesive belt and the ridge of the protruding portion may contact in a predetermined area (width). In addition, the ridge of the platen 18 according to the embodiment is formed along the transport direction A of the medium for recording P; however, it is not limited to such a configuration, and for example, the ridge may be formed along the reciprocating direction B.

As illustrated in FIGS. 4B and 5B, the platen 18 of the recording apparatus 1 according to the first and second embodiments is subjected to the friction relief processing 34 only on the face 39 which faces the end portion (end portion in reciprocating direction B) in the width direction of the adhesive belt 10 in the portion 20 which faces the pressing roller 12.

Meanwhile, as illustrated in FIG. 6B, the platen 18 of the recording apparatus 1 according to the embodiment is subjected to the friction relief processing 34 in the entire adhesive belt 10 in the width direction in the portion 20 which faces the pressing roller 12.

However, it is not limited to such a configuration, and the friction relief processing 34 in the recording apparatus 1 according to the first and second embodiments may be performed in the entire adhesive belt 10 in the width direction in the portion 20 which faces the pressing roller 12, or the friction relief processing 34 in the recording apparatus 1 according to the third embodiment may be performed only on the face 39 which faces the end portion of the adhesive belt 10 in the width direction in the portion 20 which faces the pressing roller 12.

The invention is not limited to the above described embodiments, various modifications can be made in the scope of the invention which is described in claims, and it is needless to say that those are also included in the scope of the invention.

This application claims priority under 35 U.S.C. §119 to Japanese Patent Application No. 2016-029615, filed Feb. 19, 2016. The entire disclosure of Japanese Patent Application No. 2016-029615 is hereby incorporated herein by reference.

What is claimed is:

1. A recording apparatus comprising:
a transport belt which configured to transport a medium;
a pressing roller which configured to press the medium onto the transport belt; and
a support unit which supports the transport belt,
wherein at least a part of a portion of the support unit that faces the pressing roller with the transport belt disposed therebetween is subjected to friction relief,
wherein the support unit is subjected to friction relief on a face which faces an end portion in a width direction of the transport belt, and
wherein the support unit is not subjected to friction relief on a face which faces a center portion in the width direction of the transport belt.

2. The recording apparatus according to claim 1,
wherein the support unit is subjected to reduction of the contact area with respect to the transport belt, for friction relief.

3. The recording apparatus according to claim 2,
wherein the support unit is provided with a protruding portion for reduction of the contact area, and an apex portion of the protruding portion is in contact with the transport belt.

4. The recording apparatus according to claim 2,
wherein the support unit is provided with a protruding portion including a ridge for reduction of the contact area, and the ridge is in contact with the transport belt.

5. The recording apparatus according to claim 4,
wherein the ridge is formed in a transport direction of the medium.

6. The recording apparatus according to claim 1,
wherein a sliding property improving material with which sliding properties with respect to the transport belt are improved is disposed in the support unit, for friction relief.

7. The recording apparatus according to claim 6, wherein the support unit is coated with the sliding property improving material, for friction relief.

8. The recording apparatus according to claim 6, wherein the support unit is formed of the sliding property improving material, for friction relief.

9. The recording apparatus according to claim 1, wherein the transport belt has a support face which faces the medium and on which an adhesive is painted.

* * * * *